US005248276A

United States Patent [19]

Deleon

[11] Patent Number: 5,248,276

[45] Date of Patent: Sep. 28, 1993

[54] TOY AIRPORT LANDING FIELD

[76] Inventor: Herbert Deleon, 2938 N. Elston, Chicago, Ill. 60618

[21] Appl. No.: 950,178

[22] Filed: Sep. 24, 1992

[51] Int. Cl.[5] ..... A63H 17/00; A63H 3/52; A63H 33/26

[52] U.S. Cl. ..... 446/477; 446/485; 446/7

[58] Field of Search ..... 446/7, 91, 118, 230, 446/231, 423, 444, 476, 477, 485, 489

[56] References Cited

U.S. PATENT DOCUMENTS

| | | | |
|---|---|---|---|
| 3,237,341 | 3/1966 | Janning | 446/91 |
| 3,530,615 | 9/1970 | Meyer | 446/91 |
| 3,605,334 | 9/1971 | Genin | 446/7 |
| 3,654,710 | 4/1972 | Barnard | 446/485 X |
| 3,664,055 | 5/1972 | Bass et al. | 446/477 |
| 3,978,609 | 9/1976 | English | 446/7 |
| 4,203,053 | 5/1980 | Shephard | 446/477 X |
| 4,508,511 | 4/1985 | McQueen | 446/485 X |
| 4,971,592 | 11/1990 | Carcia | 446/485 X |

*Primary Examiner*—Robert A. Hafer
*Assistant Examiner*—D. Neal Muir
*Attorney, Agent, or Firm*—Leon Gilden

[57] ABSTRACT

A compact landing field for use by individuals, and particularly children, to include airport landing field simulation, including a rigid first board overlying a resilient second board, with the first board having a conductive path in operative communication with various patterns of light-emitting diode lights to simulate a landing field strip of L-shaped configuration and a heliport, with the switching operative through sequencing and flashing units to effect visual and desired effects relative to the field structure.

6 Claims, 4 Drawing Sheets

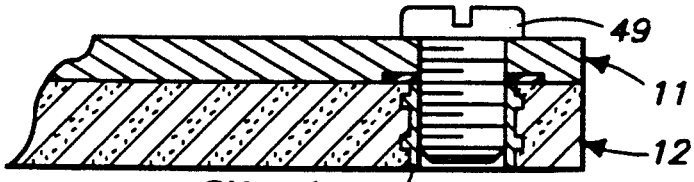
Fig. 3
Fig. 4
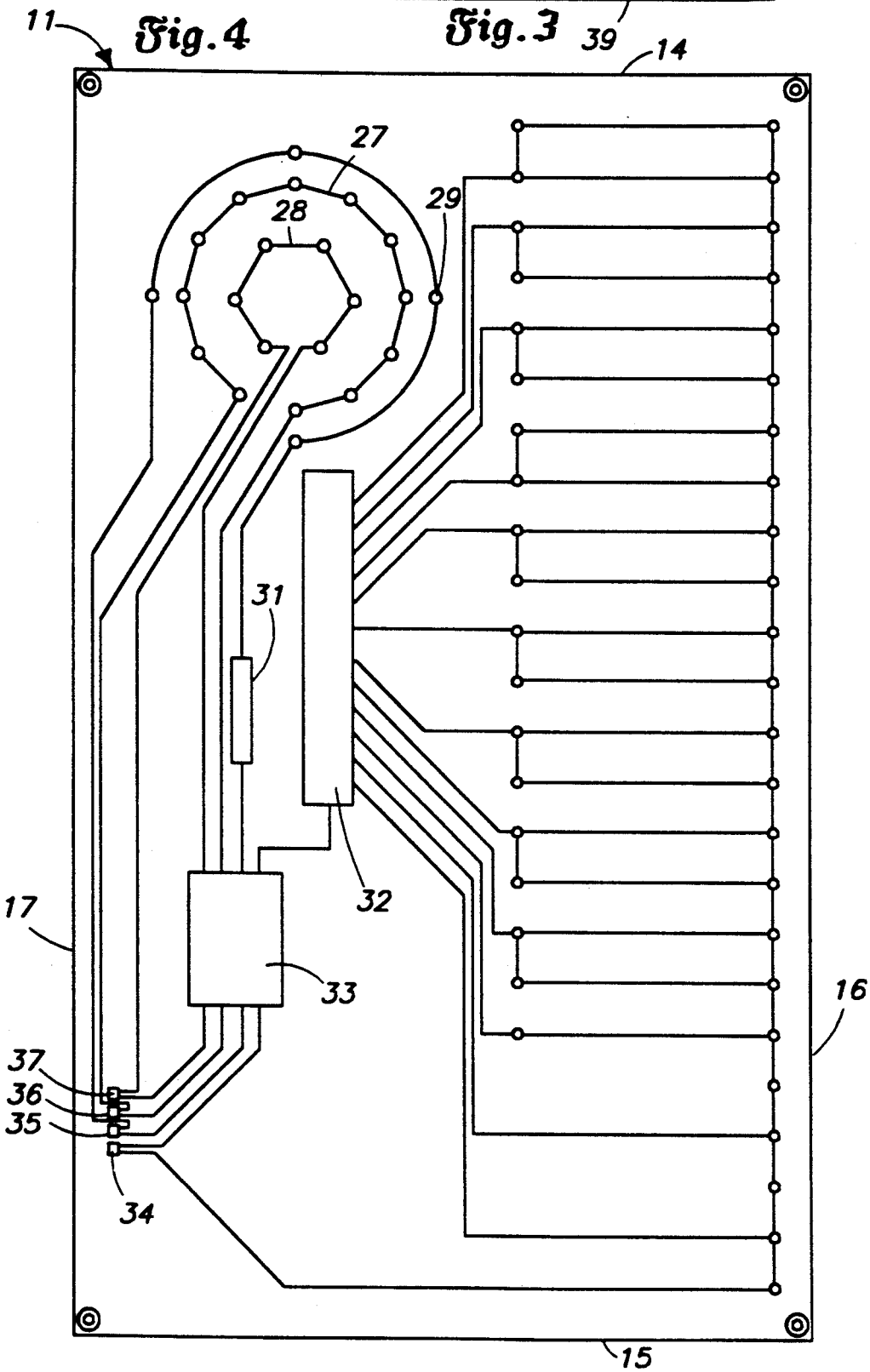

TOY AIRPORT LANDING FIELD

BACKGROUND OF THE INVENTION

1. Field of the Invention

The field of invention relates to toy airport apparatus, and more particularly pertains to a new and improved toy airport landing field wherein the same is arranged to simulate a landing field relative to airports for the entertainment and amusement of children and the like.

2. Description of the Prior Art

Toy apparatus to simulate various constructural components are available in the prior art wherein with children interested in the varying article aspect are limited to toys of relative simulation relative to an airport field. The instant invention attempts to overcome deficiencies of the prior art by providing for illumination simulation relative to a toy airport field permitting a greater degree of reality and education in the nature of airport relating landing field structure and in this respect, the present invention substantially fulfills this need.

SUMMARY OF THE INVENTION

In view of the foregoing disadvantages inherent in the known types of toy airport apparatus now present in the prior art, the present invention provides a toy airport landing field wherein the same utilizes various light sequencing structure to simulate an airport landing field organization. As such, the general purpose of the present invention, which will be described subsequently in greater detail, is to provide a new and improved toy airport landing field which has all the advantages of the prior art toy airport apparatus and none of the disadvantages.

To attain this, the present invention provides a compact landing field for use by individuals, and particularly children, to include airport landing field simulation, including a rigid first board overlying a resilient second board, with the first board having a conductive path in operative communication with various patterns of light-emitting diode lights to simulate a landing field strip of L-shaped configuration and a heliport, with the switching operative through sequencing and flashing units to effect visual and desired effects relative to the field structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy airport landing field which has all the advantages of the prior art toy airport apparatus and none of the disadvantages.

It is another object of the present invention to provide a new and improved toy airport landing field which may be easily and efficiently manufactured and marketed.

It is a further object of the present invention to provide a new and improved toy airport landing field which is of a durable and reliable construction.

An even further object of the present invention is to provide a new and improved toy airport landing field which is susceptible of a low cost of manufacture with regard to both materials and labor, and which accordingly is then susceptible of low prices of sale to the consuming public, thereby making such toy airport landing fields economically available to the buying public.

Still yet another object of the present invention is to provide a new and improved toy airport landing field which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a pay-t of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view, taken along the lines 3—3 of FIG. 1 in the direction indicated by the arrows.

FIG. 4 is an orthographic bottom view of the first board member.

DESCRIPTION OF THE PREFERRED EMBODIMENT

Figure 1:
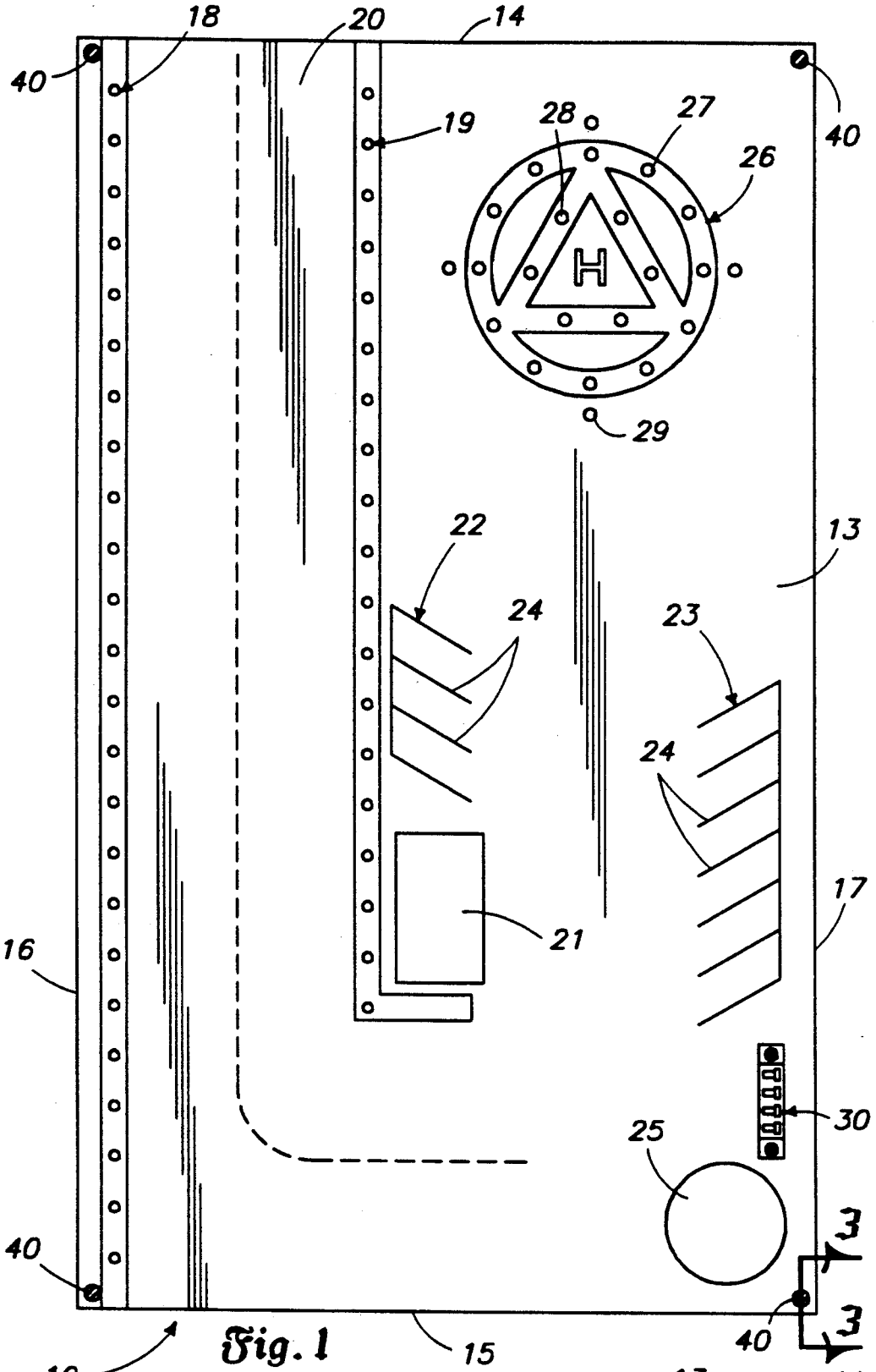
FIG. 1 is an orthographic top view of the instant invention.
Figure 2:
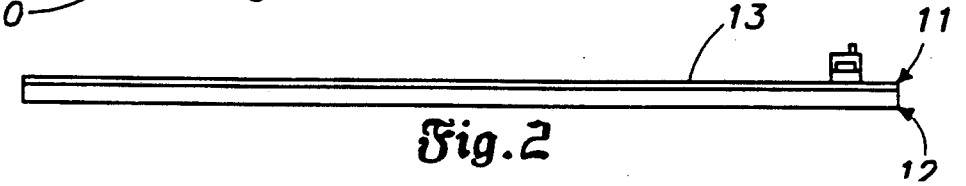
FIG. 2 is an orthographic end view of the invention.
Figure 6:
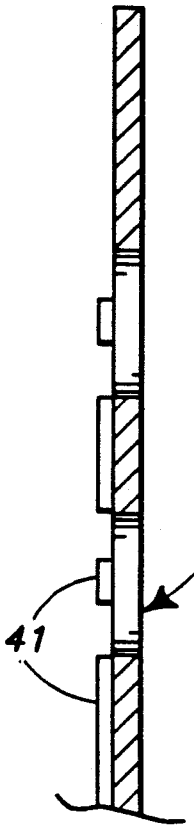
FIG. 6 is an orthographic view, taken along the lines 6—6 of FIG. 5 in the direction indicated by the arrows.
Figure 5:
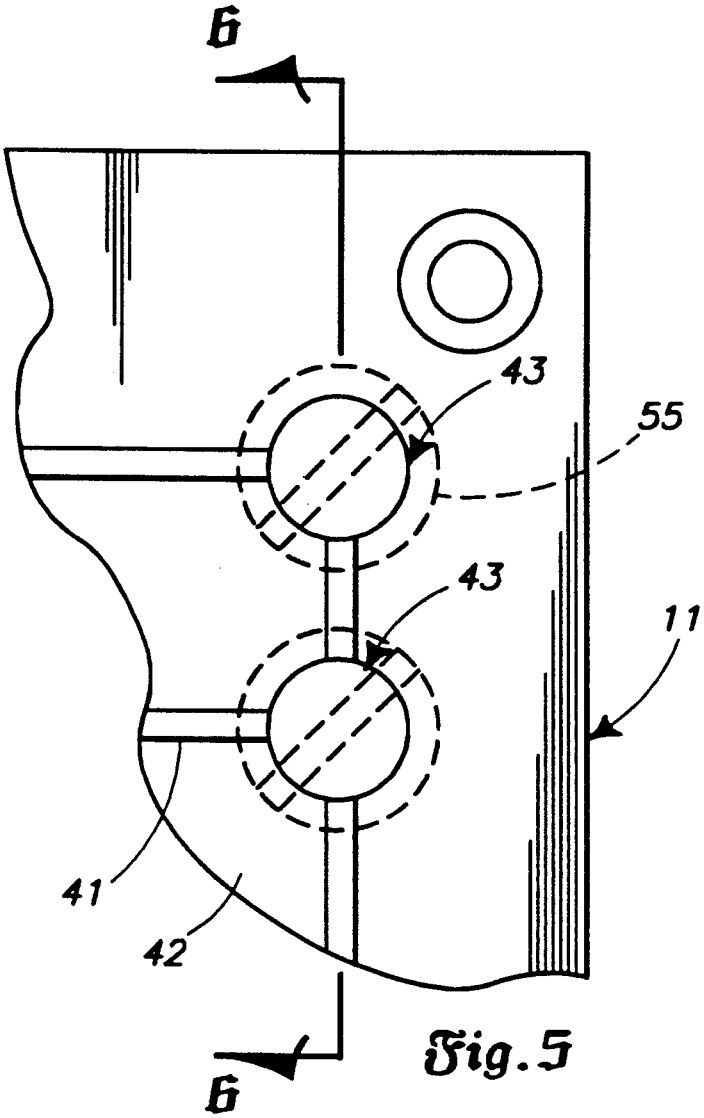
FIG. 5 is an orthographic view of the electrical pathway of the landing field structure.
Figure 7:
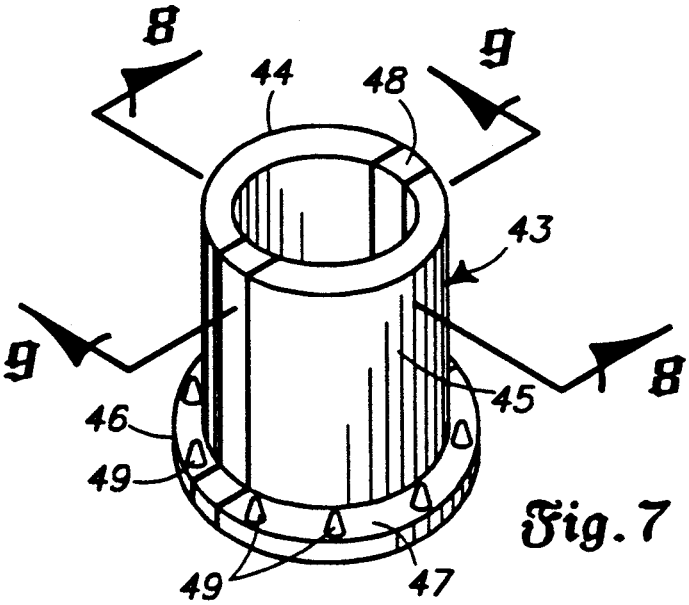
FIG. 7 is an isometric illustration of light-emitting diode socket structure.
Figure 9:
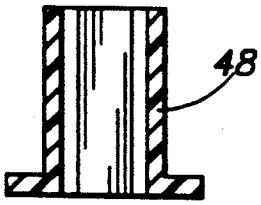
FIG. 9 is an orthographic view, taken along the lines 9—9 of FIG. 7 in the direction indicated by the arrows.
Figure 8:
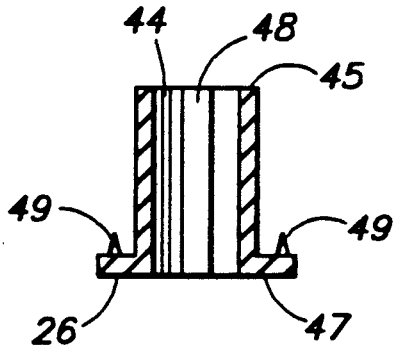
FIG. 8 is an orthographic view, taken along the lines 8—8 of FIG. 7 in the direction indicated by the arrows.
Figure 10:
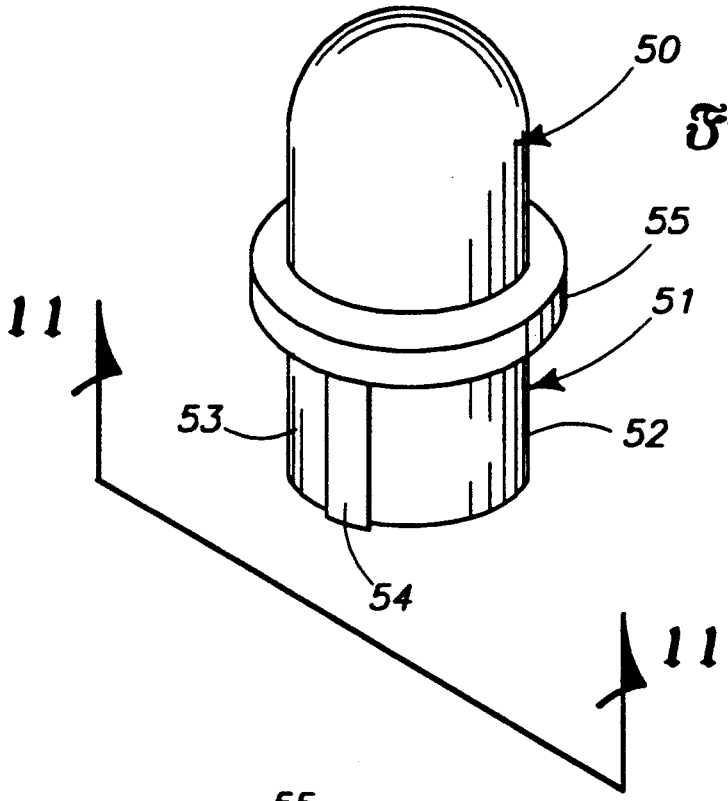
FIG. 10 is an isometric illustration of an illumination bulb utilized by the invention.
Figure 11:
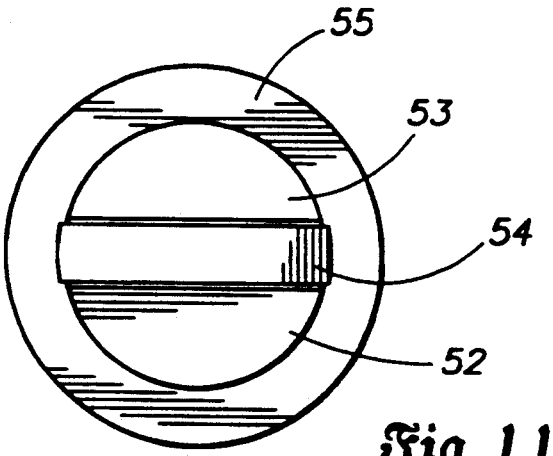
FIG. 11 is an orthographic view, taken along the lines 11—11 of FIG. 10 in the direction indicated by the arrows.

With reference now to the drawings, and in particular to FIGS. 1 to 11 thereof, a new and improved toy airport landing field embodying the principles and concepts of the present invention and generally designated by the reference numeral 10 will be described.

More specifically, the toy airport landing field 10 of the instant invention essentially comprises a first rigid board 11 having a first board planar top surface 13 mounted in a coextensive and contiguous relationship relative to an underlying second resilient board 12. The first board includes a first end 14 spaced from and parallel a second end 15, with a first side 16 spaced from a second side 17. A first row of light-emitting diode (L.E.D.) light members 18 of a first length spaced apart an equal spacing relative to one another parallel to the first side 16. A second row of L.E.D. light members 19 are arranged parallel and spaced from the first row of L.E.D. light members 18, wherein the second row is of a second length less than the first length terminating in a spaced relationship relative to the second end 15 and originating at the first end 14, with the first and second row of light members 18 and 19 orthogonally oriented between the first and second ends 14 and 15. The first and second rows of L.E.D. light members 18 and 19 define an L-shaped runway path 20 extending from the first end 14 to the second end 15 and orthogonally oriented to the first row of light members 18 extending beyond the second row to utilize space in a greater degree of efficiency relative to the configuration of the first board 11. To enhance realism relative to the use of the organization, first and second rows of airplane or vehicular parking spaces 22 and 23 are provided having parallel indicia lines 24 to define the spaces to provide for storage of simulation airplane members (not shown). Further, a tower space 25, as well as a storage building space 21, are provided for positioning various building simulations thereon. A heliport space 26 is provided between the second row of light members 19 and the second side 17 in adjacency relative to the first end 14. Board space 26 includes an outer annular array of light-emitting diode lights 27 of a first coloration, typically green, with an inner annular array of L.E.D. lights 28 concentric relative to the outer annular array of L.E.D. lights 27, with the inner array of a second coloration, typically red. A plurality of blinking light-emitting diode lights 29 are spaced exteriorly and concentric relative to the inner and outer annular array of lights 28 and 27, with the blinking lights 29 spaced ninety degrees relative to one another about the outer array 27.

A switch panel 30 is provided having respective first, second, third, and fourth switch members 34, 35, 36, and 37 respectively (see FIG. 4). A flasher unit 31 is operative through a battery unit 33 for actuation of the first and second rows of light members 18 and 19 that are operative to initiate sequencing of illumination pairs from the first end 14 to the second end 15. The second switch member 35 is operative through the battery unit 33 to effect illumination of the blinking L.E.D. lights 29 operative through a flasher unit 31 in electrical communication with a battery 33. The third switch member 36 is operative through the battery member to effect illumination of the outer annular array of L.E.D. lights 27, with the fourth switch member 37 operative to effect illumination of the inner annular array of L.E.D. lights 28. First switch 34 is operative through electrical coupling 32 to selectively direct illumination of lights 18 and 19.

The first and second boards are secured together (see FIG. 3) utilizing a rigid polymeric internally threaded cylindrical socket 39 orthogonally and fixedly directed through the second resilient board 12 to receive an externally threaded fastener 40 directed through the first and second boards 11 and 12 securing the boards together. The polymeric socket 39 (any suitable insulative material may be utilized) is arranged to avoid electrical interference with the circuitry of the organization utilizing electrical pathways 41 (see FIGS. 5 and 6) in communication with L.E.D. light sockets 43 directed into the first board bottom surface 42. The L.E.D. light socket 43 includes a first metallic semi-cylindrical sleeve 44 concentric relative to and coextensive with a second metallic semi-cylindrical sleeve 45, with the first and second sleeves 44 and 45 having first and second respective sleeve flanges 46 and 47 in a coplanar relationship, with the first and second flanges including piercing anchor projections 49 mounted thereon to enhance securement within and enhance electrical communication with the electrical path 41 relative to the first board 11. An insulative diametrically aligned band 48 is oriented between the first and second metallic semi-cylindrical sleeves 44 and 45, as well as the first and second sleeve flanges 46 and 47 to provide for first and second contact surfaces relative to the first and second sleeves 44 and 45. Each socket includes an L.E.D. bulb 50 having a bulb base 51, with the bulb base 51 formed with a respective bulb first and second metallic semi-cylindrical portion 52 and 53 having a bulb insulative web 54 therebetween coincident with the insulative band 48 of an associated socket 43. Each bulb further includes an annular abutment flange 55 at a junction of the bulb So and the base 51 to properly orient and mount each respective bulb within an associated socket. In this manner, the first and second boards may be disassembled for replacement of the bulbs, as well as the battery member 33 if desired, to ease maintenance and prolong operative use of the instant organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toy airport landing field, comprising, a first rigid board ad a second resilient board, with the first rigid board coextensive with the second resilient board, with the first rigid board having a planar top surface and a planar bottom surface, the first rigid board including a first end spaced from and parallel a second end, and a first side spaced from a second side, with the first side orthogonally oriented between the first end and the second end, and a first row of light-emitting diode light members orthogonally oriented between the first end and the second end in adjacency to the first side extending coextensively between the first end and the second end, with the first row of light members having individual L.E.D. lights spaced apart a predetermined spacing, the first row of light members having a first length, and a second row of light-emitting diode light members arranged parallel relative to the first row of light members, with the second row of light members having a second length less than the first length, and the second row of light members includes individual L.E.D. lights spaced apart said predetermined spacing, wherein the second row of L.E.D. light members extends from the first end into an orientation spaced from the second end, and markings and indicia delineating an L-shaped runway path extending from the first end to the second end and orthogonally oriented relative to the first row of L.E.D. light members and the second row of L.E.D. light members extending laterally beyond the second row of L.E.D. light members, and switch means for selective actuation of the light members in a sequencing orientation from the first end to the second end along adjacent pairs of L.E.D. light members of the first and second row of L.E.D. light members.

2. A landing field as set forth in claim 1 including a heliport space having an outer annular array of L.E.D. light members of a first coloration, and a concentric inner annular array of L.E.D. light members of a second coloration, and blinking L.E.D. lights concentric relative to the outer annular array of L.E.D. lights positioned exteriorly thereof, wherein the blinking L.E.D. lights are oriented ninety degrees relative to one another relative to the outer annular array of L.E.D. lights.

3. A landing field as set forth in claim 2 wherein the first board bottom surface includes a battery member, and a sequencing unit and a flasher unit, and the switch means includes a first switch operative through the battery member and the sequencing unit to effect sequential illumination of the first and second row of L.E.D. light members, with the switch means including a second switch member in electrical communication through the battery member and the flasher unit in electrical communication with the blinking L.E.D. lights, and the switch means further includes a third switch member in electrical communication with the battery member and the outer annular array of L.E.D. lights, and the switch means further includes a fourth switch member in electrical communication to the battery member and the inner annular array of L.E.D. lights.

4. A landing field as set forth in claim 3 wherein each of the individual L.E.D. lights includes an L.E.D. light socket mounted within the first board, wherein each light socket includes a first metallic semi-cylindrical sleeve coextensive with and concentric relative to a second metallic semi-cylindrical sleeve, and a first sleeve flange mounted orthogonally relative to the first sleeve, and a second sleeve flange orthogonally mounted to the second sleeve, with the first sleeve flange and the second sleeve flange coplanar and an insulative band directed between the first sleeve, the second sleeve, and the first flange and the second flange, and each individual L.E.D. light includes an L.E.D. bulb mounted within said L.E.D. light socket, with each L.E.D. bulb having a bulb base including a first semi-cylindrical portion and a second semi-cylindrical portion coextensive relative to one another, with an insulative web mounted between the first semi-cylindrical portion and the second semi-cylindrical portion, with the first portion in contiguous communication with the first sleeve, and the second portion in contiguous communication with the second sleeve.

5. A landing field as set forth in claim 4 wherein the first flange and the second flange each include piercing anchor projections of electrically conductive material mounted on the first sleeve flange and the second sleeve flange, and wherein each L.E.D. bulb base includes an annular abutment flange for abutment with a respective L.E.D. light socket.

6. A landing field as set forth in claim 5 wherein the second board includes at least one electrically insulative internally threaded fastener socket, with at least one fastener directed through the first board directed into the fastener socket.

* * * * *